US008330608B2

(12) United States Patent
Du et al.

(10) Patent No.: US 8,330,608 B2
(45) **Date of Patent: *Dec. 11, 2012**

(54) SYSTEMS AND METHODS FOR BATTERY STATUS INDICATION

(75) Inventors: Sterling Du, Palo Alto, CA (US); Liusheng Liu, San Jose, CA (US); Oleksandr Kokorin, San Jose, CA (US)

(73) Assignee: O2Micro, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/276,706

(22) Filed: Oct. 19, 2011

(65) Prior Publication Data

US 2012/0038483 A1 Feb. 16, 2012

Related U.S. Application Data

(63) Continuation of application No. 11/713,164, filed on Mar. 1, 2007, now Pat. No. 8,044,815.

(60) Provisional application No. 60/779,341, filed on Mar. 3, 2006.

(51) Int. Cl.
*G08B 21/00* (2006.01)

(52) U.S. Cl. ..... 340/636.13; 340/366.12; 340/636.19

(58) Field of Classification Search ..... 340/636.1, 340/636.11, 636.12, 636.13, 636.17, 636.19, 340/636.2; 320/130, 132, 139; 315/224, 315/308; 363/21.17, 89

See application file for complete search history.

(56) References Cited

U.S. PATENT DOCUMENTS

| | | | | |
|---|---|---|---|---|
| 5,661,645 | A * | 8/1997 | Hochstein | 363/89 |
| 5,754,124 | A * | 5/1998 | Daggett et al. | 340/908.1 |
| 5,767,659 | A * | 6/1998 | Farley | 320/106 |
| 5,859,506 | A * | 1/1999 | Lemke | 315/308 |
| 6,784,640 | B2 * | 8/2004 | Mizuta et al. | 320/130 |
| 8,044,815 | B2 * | 10/2011 | Du et al. | 340/636.13 |

FOREIGN PATENT DOCUMENTS

| | | |
|---|---|---|
| CN | 2453555 Y | 10/2001 |
| CN | 2643330 Y | 9/2004 |

OTHER PUBLICATIONS

English Translation of Office Action from China Patent office for Application No. 2007100800365.

* cited by examiner

*Primary Examiner* — Van T. Trieu

(57) ABSTRACT

A method and apparatus are provided to indicate battery capacity status. Different blinking frequencies of an LED correspond to different battery states of charge. Furthermore, the present invention provides a smooth visual brightness change of the LED by providing the appropriate LED current according to human eye characteristics.

16 Claims, 8 Drawing Sheets

SYSTEMS AND METHODS FOR BATTERY STATUS INDICATION

RELATED APPLICATIONS

This application is a continuation application of the commonly-owned U.S. patent application Ser. No. 11/713,164, filed Mar. 1, 2007, now U.S. Pat. No. 8,044,815, which itself claims benefit of U.S. provisional patent application Ser. No. 60/779,341, filed Mar. 3, 2006, both of which are fully incorporated herein by reference.

FIELD OF THE INVENTION

The invention relates to status indication techniques for electronic devices, more specifically, to status indication of battery capacity.

BACKGROUND

A natural shortcoming of electronic devices that use batteries as a power source is battery capacity limitations. Unexpected power loss can cause data loss and other unexpected malfunctions. To avoid this, some electronic devices provide battery status indications (e.g. full battery status, empty battery status, or the level of available battery capacity in use) to inform users of battery status so that the users can take some action, such as saving data, before the battery depletes its energy and shuts down the system. Normally, one or more LEDs are used as an indicator to inform customers of the battery status.

It should be noted that the battery status herein refers to battery status, battery charging status or battery state of charge. In one embodiment, the battery capacity status is representative of a remaining battery capacity level.

There are some conventional methods or devices for indicating the battery status of an electronic device. U.S. Pat. No. 6,459,242 provides a pulse number method for indicating battery charge status by relating the number of pulses that occur in a predetermined time period with a certain battery status. By counting the blinking times in the predetermined time period, customers are able to know the corresponding battery status. U.S. Pat. Nos. 5,629,605 and 5,099,210 disclose a duty cycle method to indicate the charge status. In this approach, the amount of ON time exhibited by an LED over a predetermined period corresponds to battery status. However, a drawback of these methods is that the brightness of the indicator changes sharply due to the sudden change between ON and OFF states of the LED, which can cause visual discomfort to users. Another problem is that an extended period of time is needed to read the pulse number or sense the amount of ON time of the LED over a certain period.

U.S. Pat. No. 6,956,478 introduces a method using multiple LEDs with different colors. These different colors represent different charging states. The problem with this method is that some users are color-blind and are not able to distinguish between different colors. In addition, using multiple LEDs can increase cost.

Multiple LED scale methodologies are also commonly used in indicating battery status. In such approaches, the number of LEDs in an ON state represents a corresponding battery status. The multiple LEDs may be coupled to a controller either in parallel or in series. U.S. Pat. No. 6,950,030 discloses a multiple LED scale method that uses a series LED connection. However, in addition to multiple LEDs, a special high-voltage drive device and a high-voltage power source are also required. Multiple LED scale methods with independent LED control can also be found in conventional systems. The multiple LEDs are coupled in parallel to a controller and drive device. However, in addition to multiple LEDs, associated multiple pins for LED control are required, which is not cost effective.

Therefore, it is to a convenient, reliable, and cost effective battery status indication method or device that the present invention is primarily directed.

SUMMARY

In one embodiment, the present invention uses only one LED for battery status indication. Different blinking frequencies of the LED correspond to different battery states of charge. Advantageously, the present invention provides a smooth visual brightness change of the LED by providing the appropriate LED current in accord with human eye characteristics.

In yet another embodiment, the present invention employs two LEDs with different colors for battery status indication with only one or two pins for LED control. The full battery state, empty battery state, and intermediate state (the state between full and empty battery state) are represented by different colors and different blinking frequencies for color-blind persons. In the case of the intermediate state, the way of indicating the amount of battery capacity is similar to the previous embodiment. Several implementations are provided.

BRIEF DESCRIPTION OF THE DRAWINGS

Features and advantages of embodiments of the invention will become apparent as the following Detailed Description proceeds, and upon reference to the Drawings, where like numerals depict like elements, and in which.

DETAILED DESCRIPTION OF THE INVENTION

Figure 1:
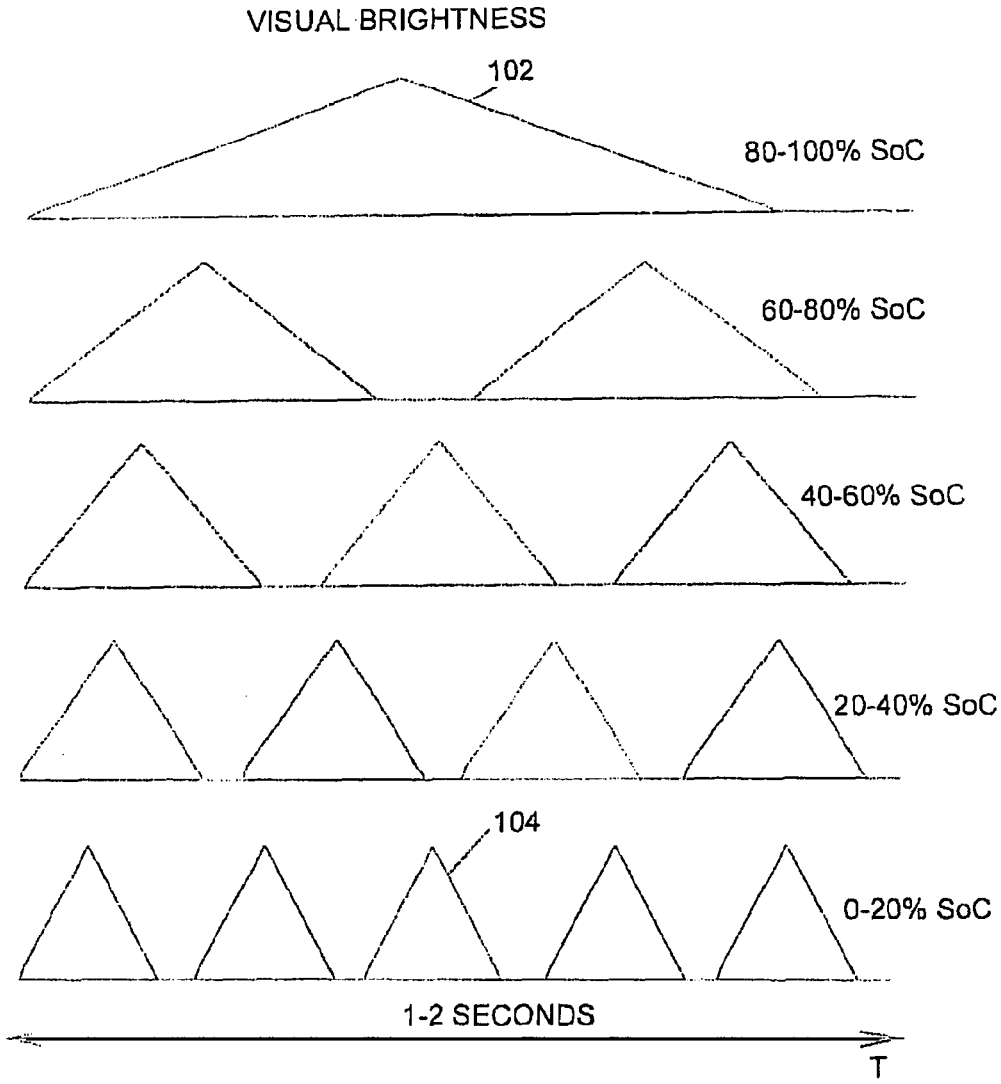
FIG. 1 illustrates the changes of visual brightness of a LED according to the variation of the battery state of charge according to one embodiment of the present invention.

FIG. 1 shows graphs that correspond to the changing visual brightness of an LED responsive to a variation of a battery state of charge. The LED is associated with an electronic device having a battery as a power source. The changing speed of visual brightness herein is also referred to as blinking frequency. In one embodiment, the present invention uses only one LED to display a battery's State of Charge (SoC) by changing the blinking frequency. Fast blinking of a light source is usually associated with a warning or danger. To take advantage of this conditioned association, it is desirable that a fast visual brightness change of an LED be representative of the event of empty battery state. In other words, the battery state of charge (SoC) is preferably inversely proportional to the changing speed of visual brightness of the LED in one embodiment of the present invention. It can be easily seen from plot 102 in FIG. 1 that when the capacity of the battery is 80%-100% of the full capacity, the changing speed of visual brightness is the lowest. When the capacity of the battery drops to 0%-20% of the full capacity as shown in plot 104, the highest speed of visual brightness changes is provided. In an alternate embodiment, the indication of a fully charged battery state might also be realized by fully turning ON of the LED without changing brightness. Moreover, the indication of a deeply discharged battery state might also be realized by fully turning OFF of the LED without brightness change.

Figure 2:
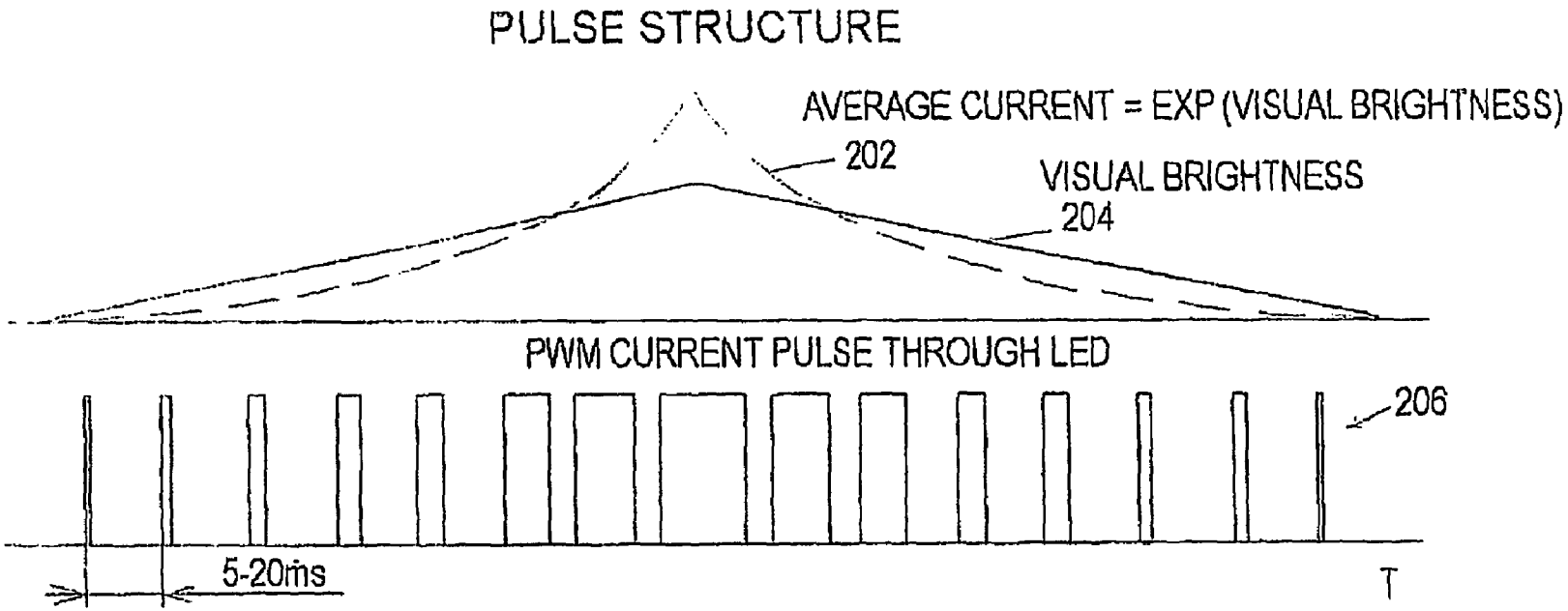
FIG. 2 illustrates the relationship between the visual brightness and the current pulses through an LED according to one embodiment of the present invention.

Additionally, taking visual comfort into consideration, it can be seen from FIG. 1 that the aforementioned LED blinking is not carried out by suddenly turning ON and OFF the LED as is done in some conventional approaches. Instead, the visual brightness of the LED is changed gradually. For example, a triangle brightness change curve with 1-2 second duration is depicted in plot 102 in FIG. 1. The visual brightness linearly increases with the SoC first and begins to decrease when reaching a certain point. Then, the visual brightness gradually dims until the LED fully turns off. Advantageously, this gradual brightness change of the LED is more visually comfortable to the users. Furthermore, it is more preferable that the fastest brightness blinking frequency be lower than 5 Hz considering human eye perception characteristics. For example, as shown in FIG. 1, 1-2 seconds include 5 cycles of the brightness change curve, that is, the blinking frequency changes are in the range of 2.5-5 Hz, which is below 5 Hz.

It should also be noted that the relationship between the SoC of the battery and the brightness change of the associated LED is not limited to inverse-proportional relationship. Moreover, alternative relationships can also be adopted, e.g. a directly proportional relationship might also be an option.

It is known that human eye has a logarithmic perception for brightness. As a result of this human eye characteristic, the average current level flowing through the LED should be produced in an exponential fashion in order to produce the visual effect of linear brightness change. As shown in FIG. 2, the solid line 204 is the linear brightness curve, while the dashed line 202 is the corresponding exponential LED average current curve.

However, it is not easy to generate a continuous exponential control current to the LED, especially for a digital logic circuitry, such as a micro processor. To solve the problem, a pulse width modulated current (PWM) 206 flowing through the associated LED is provided to emulate the exponential average current as shown in FIG. 2. The PWM pulse frequency might be in the range of 50 Hz to 200 Hz (i.e. 5 ms to 20 ms period) or even faster. Generally, objects reside in human eye's retina for about 0.1 seconds, thus, human eyes may not be able to perceive these high frequency pulses within the frequency range of 50 Hz to 200 Hz. Instead, a gradual brightness change may be perceived, as illustrated by the visual brightness trace in the figures. The pulse width is modulated in a way to create the dashed exponential current control signal. The maximum duty cycle of the pulses should be less than 50%.

It can be seen from FIG. 2 that the PWM frequency should be higher than the frequency of the visual brightness changes, or the blinking frequency. As previously discussed, the blinking frequency varies according to the battery state of charge as illustrated by the plots in FIG. 1. Since the PWM frequency remains constant, when the battery state of charge is high, for example, 80%-100%, the number of PWM signal pulses in one blinking period is increased. The pulse width of the PWM signal in each blinking period is adjusted to produce the periodic triangle wave associated with visual brightness.

Figure 3:
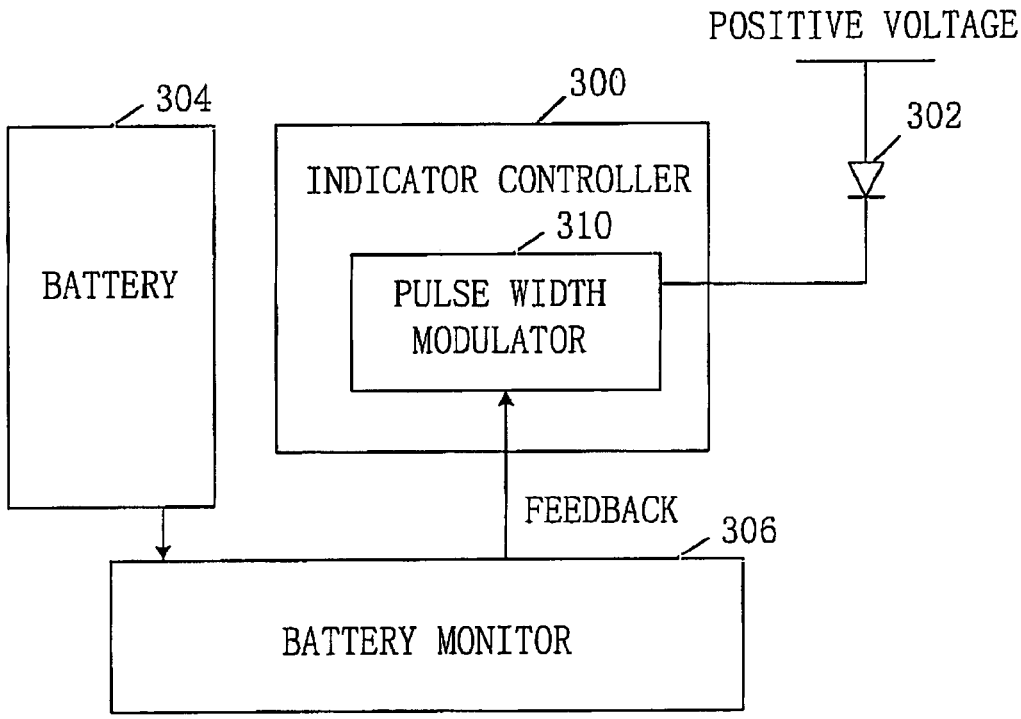
FIG. 3 illustrates an exemplary battery capacity indicator system according to one embodiment of the present invention.

FIG. 3 shows an indicator system that implements the method described above according to one embodiment of the present invention. The system includes an LED 302, an indicator controller 300, a battery 304 and a battery monitor 306. In the FIG. 3 embodiment, the LED 302 is coupled to the indicator controller 300. The positive voltage applied on the LED is a power supply to the LED. The positive voltage can be acquired from a power regulator, a system power rail, or from any other regulated power sources. The battery monitor 306 may be a conventional component coupled to the battery 304 for measuring the battery capacity status. Furthermore, the battery monitor 306 provides a feedback signal representative of the battery status, such as a remaining capacity level of the battery, to the indicator controller 300. In general, the indicator controller 300 is used to control and drive the average current flowing through the LED and create the visual brightness change according to a feedback signal as shown in FIG. 1 and FIG. 2. In one embodiment, the indicator controller 300 may be integrated into the battery monitor device or independently coupled to the battery monitor 306.

The indicator controller 300 includes a pulse width modulator 310. The pulse width modulator 310 is capable of adjusting the pulse width of the PWM signal in order to generate a periodic exponential average current. Therefore, a visual brightness change in a triangle form can be created, as shown in FIG. 1 and FIG. 2. In one embodiment, the speed of brightness change is determined by the feedback signal indicating the battery status. Therefore, by relating the blinking frequency of the LED to the battery state of charge, users are able to distinguish the different battery states of charge through observing different rates of brightness change. In one embodiment, when the battery state of charge is between 80%-100%, the blinking frequency is set to its slowest rate. In one embodiment, when the battery state of charge falls to 60%-80%, the blinking frequency is adjusted to twice the rate of the blinking frequency exhibited when the battery state of charge is between 80%-100%. In one embodiment, when the battery is near empty, the blinking frequency is highest. Additionally, the indicator controller 300 may further include a driving circuit and a current limiting circuit (not shown). The driving circuit is used to provide power capability for purposes of driving the LED. The current limiting circuit may be used to limit the average current flowing through the LED. In one embodiment, an external resistor (not shown) may be coupled to the output of the indicator controller 300 for use in driving the LED and limiting the current flowing through the LED.

Advantageously, the present invention employs a method providing different blinking frequencies to represent different battery states of charge, or remaining battery capacity level, thereby making it easier for color-blind people to appreciate the battery state of charge. More advantageously, a gradual brightness change technique is used by the present invention for the purpose of visual comfort.

Figure 4:
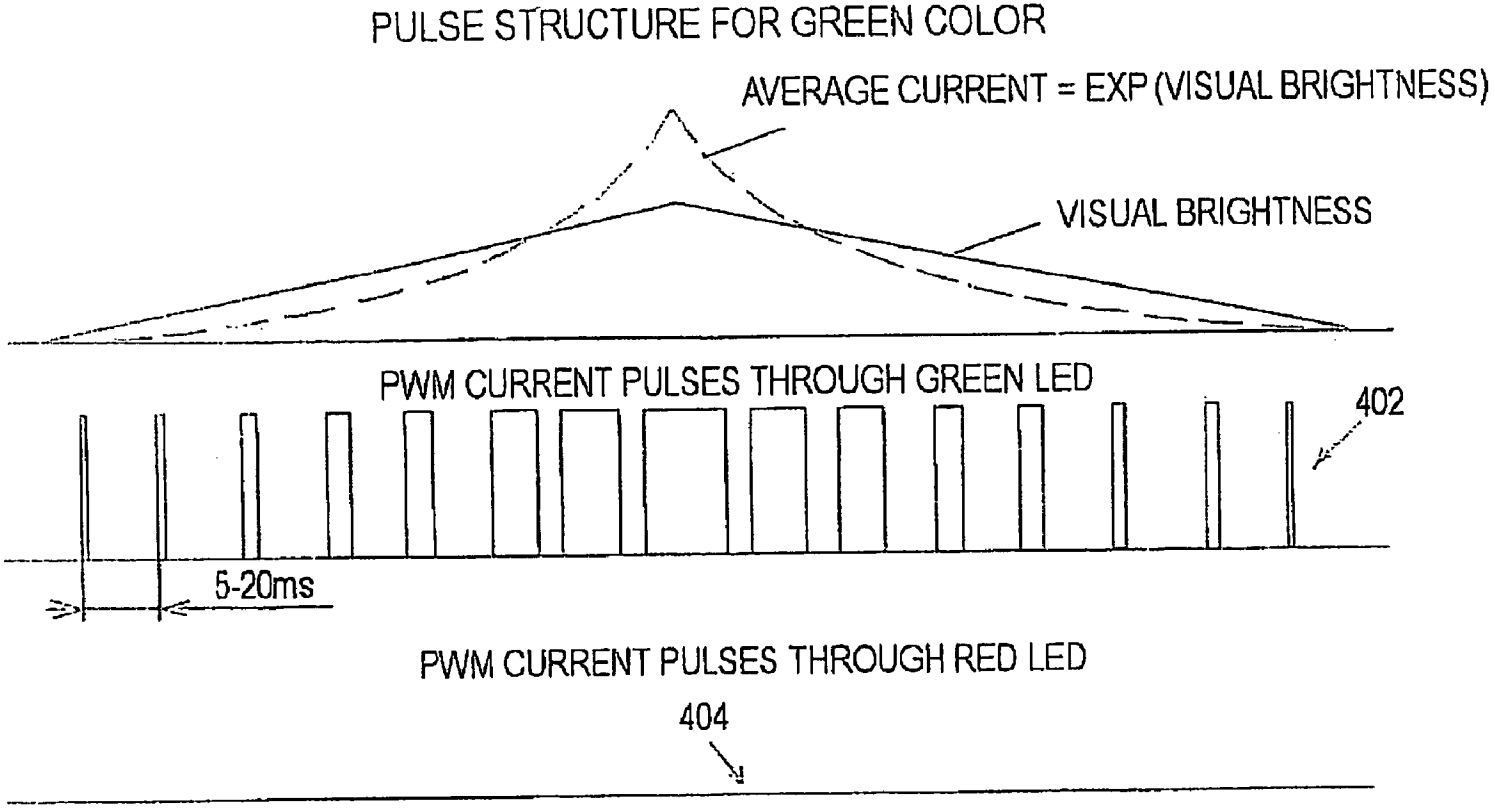
FIG. 4 illustrates the relationship between the visual brightness and the current pulses through green and red LEDs for green resulting color according to one embodiment of the present invention.

In yet another embodiment, two LEDs with different colors are provided according to the present invention. The two LEDs may be of any color as long as they are different. For example, in one embodiment, a green LED and a red LED can be used to display different battery statuses. In one embodiment, when the battery is fully charged, only the green LED blinks as shown in FIG. 4 (plot 402), or the green LED may be fully turned ON without blinking as shown in plot 404 in FIG. 4. Moreover, in one embodiment, when the battery is fully discharged, only the red LED blinks as shown in plot 502 in FIG. 5, or the red LED may be fully turned ON without blinking as shown in plot 504 in FIG. 5. It should be appreciated that in the aforementioned embodiments each one of the LEDs operates as does the LED described in FIG. 1 and FIG. 2.

Figure 6:
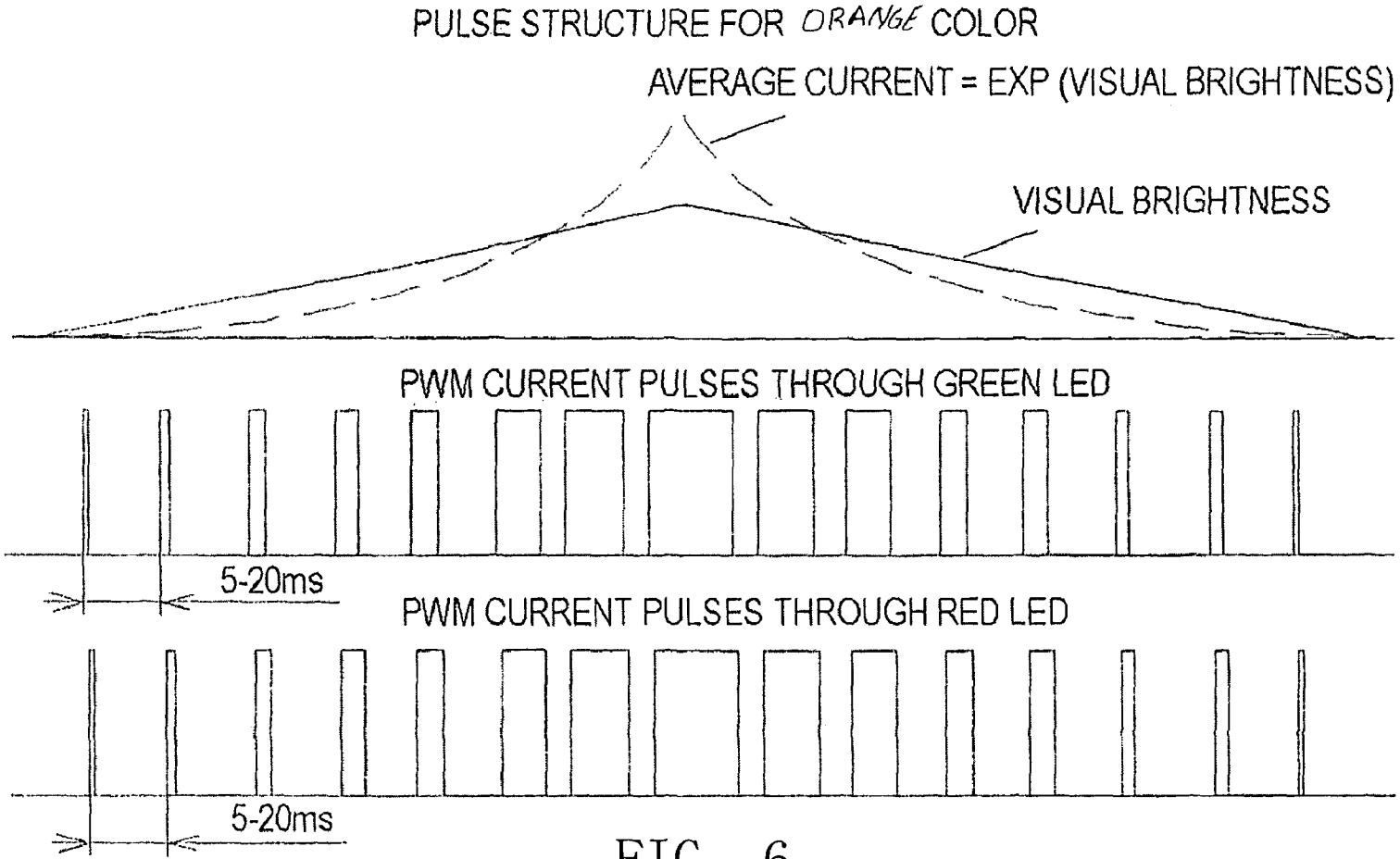
FIG. 6 illustrates the relationship between the visual brightness and the current pulses through LEDs displaying yellow color according to one embodiment of the present invention.

In one embodiment, when the battery SoC is above 0% and below 100%, both green LED and red LED can be set to blink, as shown in FIG. 6, as a result, the human eyes will get an orange color blinking effect. However, the speed of the brightness change varies with the battery SoC as illustrated in FIG. 1. The two PWM control signals for green LED and red LED can be fully in phase, or slightly time shifted as shown in FIG. 6.

Figure 5:
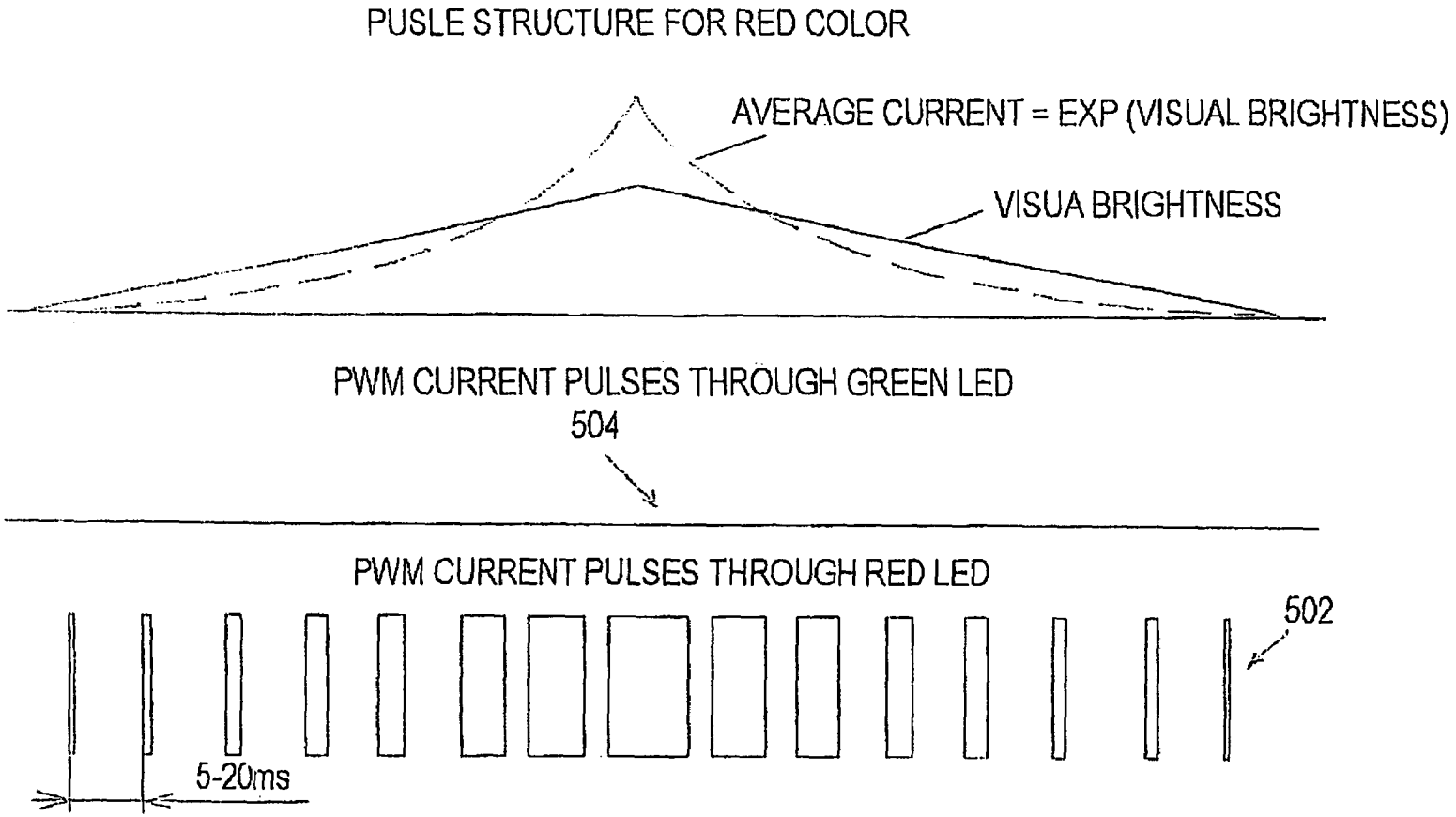
FIG. 5 illustrates the relationship between the visual brightness and the current pulses through green and red LEDs for red resulting color according to one embodiment of the present invention.
Figure 7A:
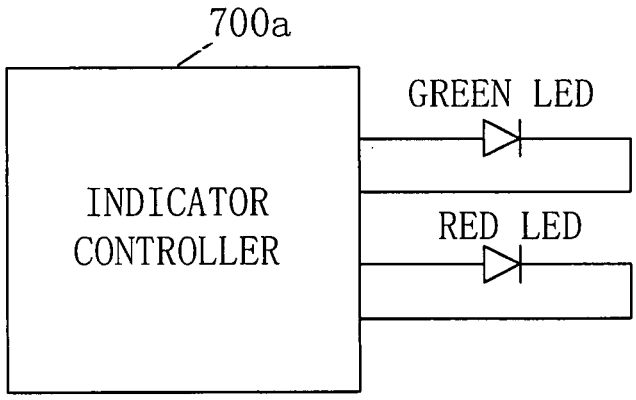
FIG. 7A illustrates an apparatus implementing one method of one embodiment of the present invention.
Figure 7B:
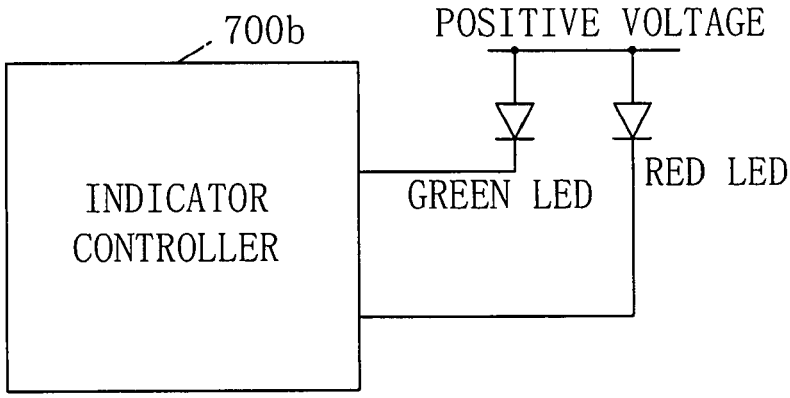
FIG. 7B illustrates an apparatus implementing one method of one embodiment of the present invention.
Figure 7C:
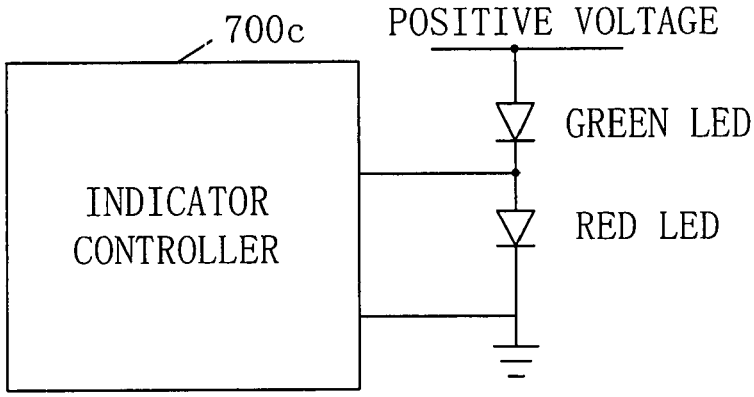
FIG. 7C illustrates an apparatus implementing one method of one embodiment of the present invention.

FIG. 7 illustrates several embodiments using the method described with reference to FIG. 4, FIG. 5 and FIG. 6. It should be noted that the functionality of the indicator controller devices 700*a*, 700*b*, 700*c* in FIG. 7A, FIG. 7B, and FIG. 7C respectively, are similar to that of the indicator controller 300 described in FIG. 3. It should also be noted that the LEDs in FIG. 7A, FIG. 7B, and FIG. 7C behave similarly although they are connected in different ways to the indicator controller device. In FIG. 7A, both the green LED and red LED acquire their power supply internally from the indicator controller device 700*a* by a coupling of their positive terminals to the indicator controller device 700*a*. In one embodiment, the two diodes may acquire power from an external positive voltage source. The negative terminals of two LEDs can be connected to the indicator controller device 700*b* using two separate pins for LED control, as illustrated in FIG. 7B. In yet another embodiment, the two LEDs may be controlled by the indicator controller device 700*c* using only one control pin as shown in FIG. 7C.

Figure 8:
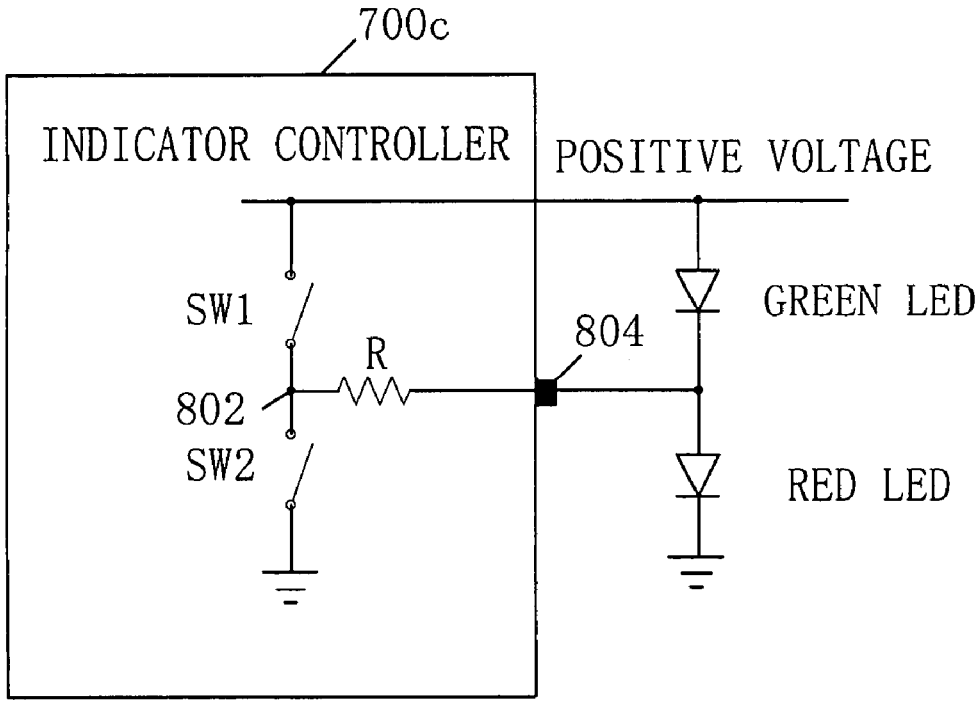
FIG. 8 illustrates a detailed schematic according to FIG. 7C according to one embodiment of the present invention.

FIG. 8 illustrates a more detailed schematic in accordance with FIG. 7C. Two switches SW1 and SW2 are used in this embodiment. Switch SW1 is coupled between the positive voltage source and node 802, while switch SW2 is coupled between the node 802 and ground. The voltage level of the positive voltage source should be less than the sum of the LEDs' threshold voltages. SW1 and SW2 are alternately and mutually exclusively set to open and close by a control signal from the indicator controller device. As a result, the green LED and the red LED alternately turn on, which makes it possible to use only one LED control pin 804 to produce the PWM current pulses to the two LEDs. In this case, the switching frequency of the two switches SW1 and SW2 should be fast enough so that the customers may not be able to easily recognize the different color switching. Instead, a visual effect of a mixed color of the two LED may be created.

It is appreciated by those skilled in the art that the method introduced herein can be widely applied to indicate a status of any event. First, a feedback signal representing the status of the event is required. Second, a PWM controller is needed to receiver the feedback signal and provides a corresponding PWM signal to one or more LEDs or lighting sources using the method presented above.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

What is claimed is:

1. A method for indicating a state of charge of an energy storage component, said method comprising:

generating a pulse signal based on said state of charge, wherein said pulse signal comprises a first plurality of consecutive pulses having durations that increase over time and a second plurality of consecutive pulses having durations that decrease over time; and providing said pulse signal to a light source, wherein an average current flowing through said light source is exponentially increased in response to said first plurality of consecutive pulses and is exponentially decreased in response to said second plurality of consecutive pulses, and wherein said average current has a frequency that causes said light source to blink at a predetermined blinking frequency.

2. The method of claim 1, wherein said light source comprises a light-emitting diode (LED).

3. The method of claim 1, wherein said energy storage element comprises a battery.

4. The method of claim 1, wherein said predetermined blinking frequency is in inverse proportion to said state of charge.

5. The method of claim 1, further comprising:

maintaining said average current constant when said energy storage component is fully charged.

6. The method of claim 1, wherein said light source comprises a first LED emitting a first color and a second LED emitting a second color, said first color being different from said second color.

7. The method of claim 6, further comprising:

turning off said second LED and maintaining an average current through said first LED constant when said energy storage component is fully charged; and turning off said first LED and maintaining an average current through said second LED constant when said energy storage component is empty.

8. A circuit for controlling a light source to indicate a status of an energy storage component, said circuit comprising:

a pulse generator that generates a pulse signal based on a state of charge of said energy storage component, said pulse signal comprises a first plurality of consecutive pulses having durations that increase over time and a second plurality of consecutive pulses having durations that decrease over time; and wherein an average current through said light source is exponentially increased in response to said first plurality of consecutive pulses and is exponentially decreased in response to said second plurality of consecutive pulses, wherein said average current has a frequency that causes said light source to blink at a predetermined blinking frequency.

9. The circuit of claim 8, wherein said predetermined blinking frequency is in inverse proportion to said state of charge.

10. The circuit of claim 8, wherein said average current is constant when said energy storage component is fully charged.

11. The circuit of claim 8, further comprising:

a monitor coupled to said energy storage component, which determines said state of charge and provides a feedback signal indicative of said state of charge to said pulse generator, wherein said pulse generator generates said pulse signal based on said feedback signal.

12. The circuit of claim 8, wherein said light source comprises a light-emitting diode (LED).

13. The circuit of claim 8, wherein said energy storage element comprises a battery.

14. The circuit of claim 8, wherein said light source comprises a first LED emitting a first color and a second LED emitting a second color, said first color being different from said second color.

15. The circuit of claim 14, wherein said second LED is turned off and said average current is constant through said first LED when said energy storage element is fully charged.

16. The circuit of claim 14, wherein said first LED is turned off and said average current is constant through said second LED when said energy storage element is empty.

* * * * *